US006478111B2

(12) United States Patent
Olson et al.

(10) Patent No.: US 6,478,111 B2
(45) Date of Patent: Nov. 12, 2002

(54) METHODS AND APPARATUS FOR INSTALLING A SAFETY LINE

(75) Inventors: Wayne L. Olson, Central Point, OR (US); Scott C. Casebolt, St. Paul Park, MN (US)

(73) Assignee: D B Industries, Inc., Red Wing, MN (US)

( * ) Notice: Subject to any disclaimer, the term of this patent is extended or adjusted under 35 U.S.C. 154(b) by 0 days.

(21) Appl. No.: 09/785,798

(22) Filed: Feb. 16, 2001

(65) Prior Publication Data

US 2001/0027897 A1 Oct. 11, 2001

Related U.S. Application Data

(60) Provisional application No. 60/183,543, filed on Feb. 18, 2000.

(51) Int. Cl.[7] ..... A47L 3/04

(52) U.S. Cl. ..... 182/3; 182/45; 182/113; 248/231.61; 248/237; 256/59

(58) Field of Search ..... 182/3, 4, 36, 45, 182/113; 248/231.61, 237, 228.5; 256/56, 65, DIG. 6

(56) References Cited

U.S. PATENT DOCUMENTS 3,802,112 A * 4/1974 Banner ..... 43/21.2
3,860,276 A * 1/1975 Lambrecht ..... 292/169
4,545,558 A * 10/1985 Crudele ..... 248/544
5,029,670 A * 7/1991 Whitmer ..... 182/113
5,143,171 A * 9/1992 Glynn et al. ..... 182/3
5,307,897 A * 5/1994 Turner et al. ..... 182/3
5,320,193 A * 6/1994 Bongiovanni et al. ..... 182/3
5,358,068 A * 10/1994 Whitmer ..... 182/113
5,398,777 A * 3/1995 Ouellette et al. ..... 182/3
5,553,685 A * 9/1996 Cook ..... 182/45
5,647,451 A * 7/1997 Riechel ..... 182/45
5,730,245 A * 3/1998 Conway ..... 182/3
6,053,279 A * 4/2000 McKenna ..... 182/36
6,173,809 B1 * 1/2001 Cole et al. ..... 182/3

* cited by examiner

*Primary Examiner*—Bruce A. Lev
(74) *Attorney, Agent, or Firm*—IPLM Group, P.A.

(57) ABSTRACT

A safety line system includes support assemblies which clamp to respective reinforcement bars protruding upward beyond the top surface of a concrete beam. The support assemblies include stanchion assemblies having respective posts that may be selectively pivoted relative to the beam. The support assemblies also preferably include end anchor assemblies that are connected to respective stanchion assemblies by respective chains.

29 Claims, 8 Drawing Sheets

100
180
186
184
182
110
188
190
140
92
91
90

FIG. 8
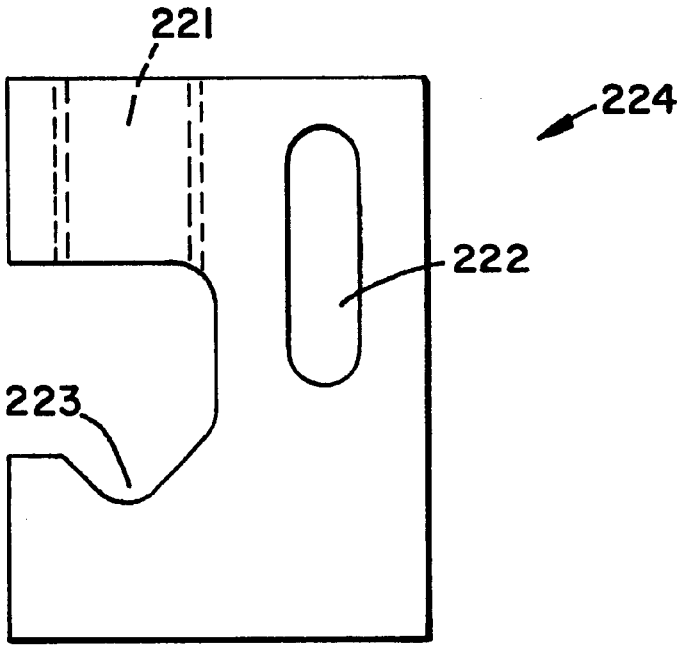
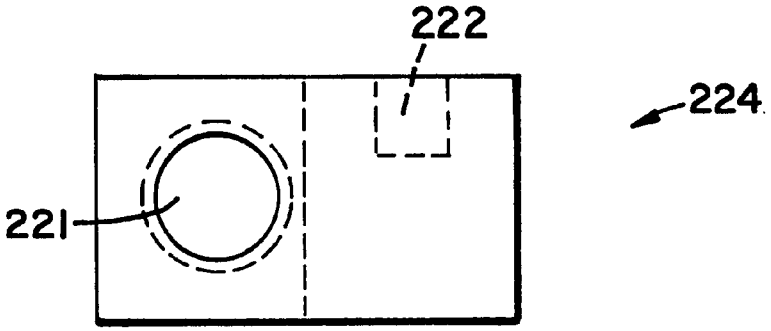
FIG. 9

METHODS AND APPARATUS FOR INSTALLING A SAFETY LINE

This application claims the benefit of U.S. provisional patent application No. 60/183,543, filed Feb. 18, 2000.

FIELD OF THE INVENTION

The present invention relates to personal safety equipment and in a preferred application for a preferred embodiment, to a safety line system that may be conveniently secured to and removed from a concrete beam having reinforcing bars which project outward from the beam.

BACKGROUND OF THE INVENTION

Various occupations and/or endeavors place people in precarious positions at relatively dangerous heights. As a result, many types of safety apparatus have been developed to reduce the likelihood of a fall and/or injuries associated with a fall. Much of the existing equipment is designed for a particular application and thus, is not necessarily well suited for use in more than one type of environment. With respect to the present invention, it was determined that a need existed for a safety device that could be readily attached to and detached from concrete beams of the type used in large public works projects and the like. One object of the invention was to design a system that could be secured relative to various reinforcement bar configurations on different types of concrete beams, without altering the beams or imposing any requirements on the manufacture of the beams. Another object of the invention was to design such a system with a horizontal safety line that would extend substantially the entire length of the beam and/or selectively pivot to alternative positions relative to the beam.

SUMMARY OF THE INVENTION

One aspect of the present invention involves the anchoring of a personnel safety system to a concrete beam of the type having a top surface and upwardly protruding reinforcement bars. The system includes a base plate having at least one slot which extends parallel to the mounting surface on the beam. Left and right hook members are slidably mounted within respective portions of the at least one slot and preferably open toward one another. Once the hook members are maneuvered into engagement with respective reinforcement bars, bolts are inserted through the base plate and threaded into respective hook members to secure the latter in place relative to the former. Each bar is clamped between a respective hook member and axially displaced bearing surfaces that face toward the respective hook member. An advantage of this system is that it accommodates beams having different reinforcement bar arrangements and thus, does not require alteration of the beams themselves.

Another aspect of the present invention involves the pivoting of a safety line relative to its support structure. Opposite ends of the safety line are anchored to opposite ends of a concrete beam or other support structure. Stanchion assemblies are positioned at intermediate positions along the safety line and secured to the beam. Each stanchion assembly includes a beam engaging base, and a post which is selectively pivotal relative to the base. The posts pivot about a common pivot axis which aligns with the anchored ends of the safety line. Additional supports are also secured between respective end stanchions and respective end anchors for the safety line. Each stanchion assembly also includes a latch which selectively releases the post for pivoting to alternative positions relative to the base. An advantage of this system is that the safety line may be moved to different positions depending upon circumstances. For example, it may be desirable to pivot the posts to parallel horizontal orientations for transportation purposes.

On a preferred embodiment, the foregoing features are incorporated into a horizontal safety line system which may be secured to a beam before it is loaded onto a truck for delivery to a job site. To the extent that people are required to stand on and/or walk along the beam (during loading, unloading, and/or installation of the beam), the system provides a suitable, fall-arrest safety line. Additional features and/or advantages may become more apparent from the more detailed description which follows.

BRIEF DESCRIPTION OF THE DRAWINGS

With reference to the Figures of the Drawing, wherein like numerals represent like parts and assemblies throughout the several views.

FIG. 8 is a top view of a hook member that is part of the base portion shown in FIG. 5;

FIG. 9 is an end view of the hook member shown in FIG. 8;

DETAILED DESCRIPTION OF THE PREFERRED EMBODIMENT

Figure 1:
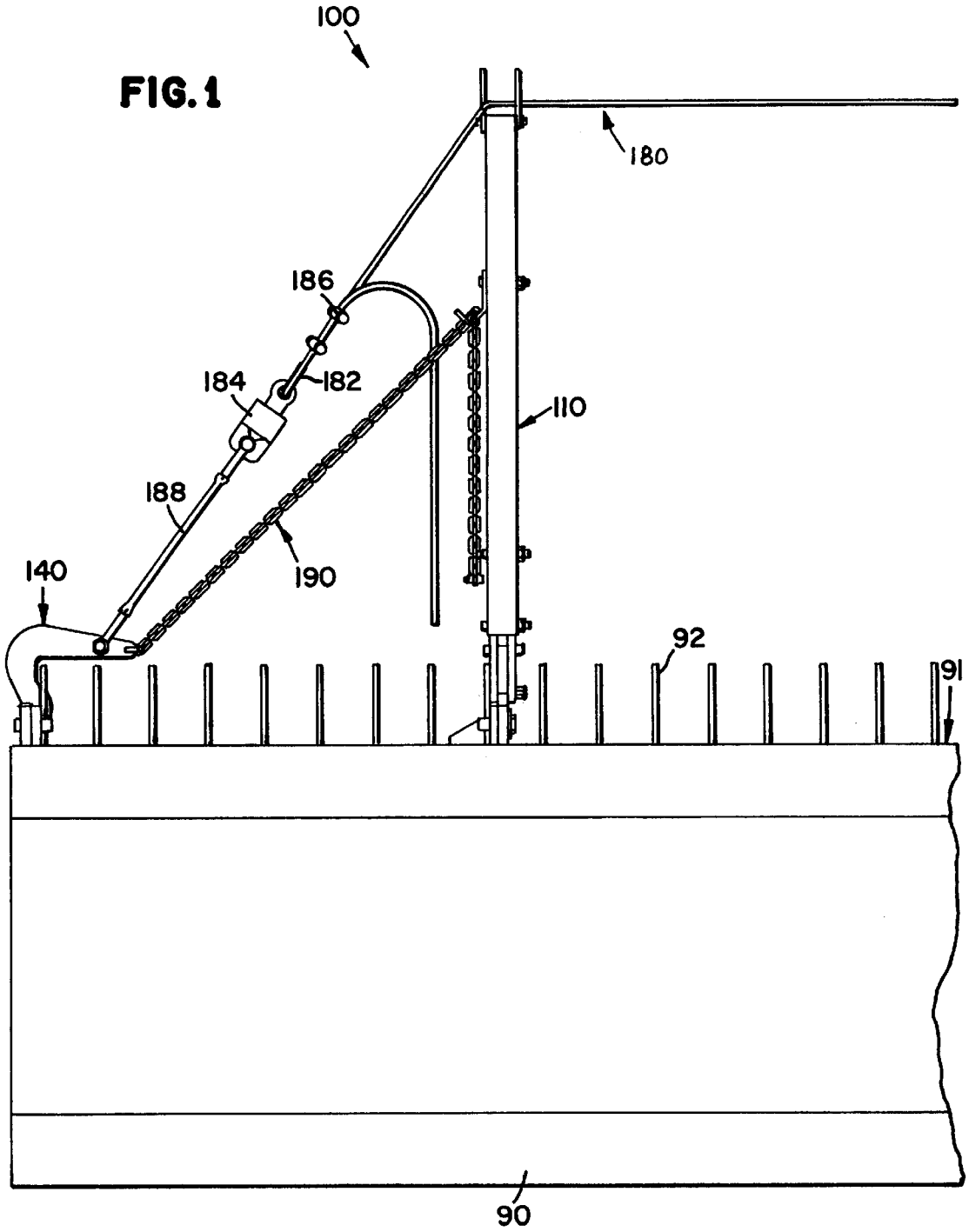
FIG. 1 is a side view of one end of a horizontal safety line system constructed according to the principles of the present invention.

A first safety system constructed and installed according to the principles of the present invention is designated as 100 in FIG. 1. In a preferred application, the system 100 provides a horizontal safety line 180 relative to a concrete beam 90 of the type having a top surface 91 and upwardly protruding reinforcement bars 92 and 94–97. However, the present invention may be applicable in other instances, as well. For example, the anchoring structure incorporated into the system 100 may be used to support other types of personal safety devices, and/or the line pivoting structure incorporated into the system 100 may be used relative to other types of support structures.

Generally speaking, the system 100 includes a stanchion assembly 110, an end anchor assembly 140, a safety line 180, and a connector 190. An opposite end of the safety line 180 (not shown) is preferably secured to a similar stanchion assembly 110 and a similar end anchor assembly 140, but the present invention is not necessarily limited to such an arrangement. For example, an opposite end of the safety line 180 could simply be secured to something on site, such as a dump truck (with the only keys to the truck preferably in the pocket of the person relying upon the safety line 180). Also, one or more additional, intermediate stanchion assemblies 110 may be disposed along the safety line 180 to provide intermediate support, depending upon the overall length of the line 180.

Figure 2:
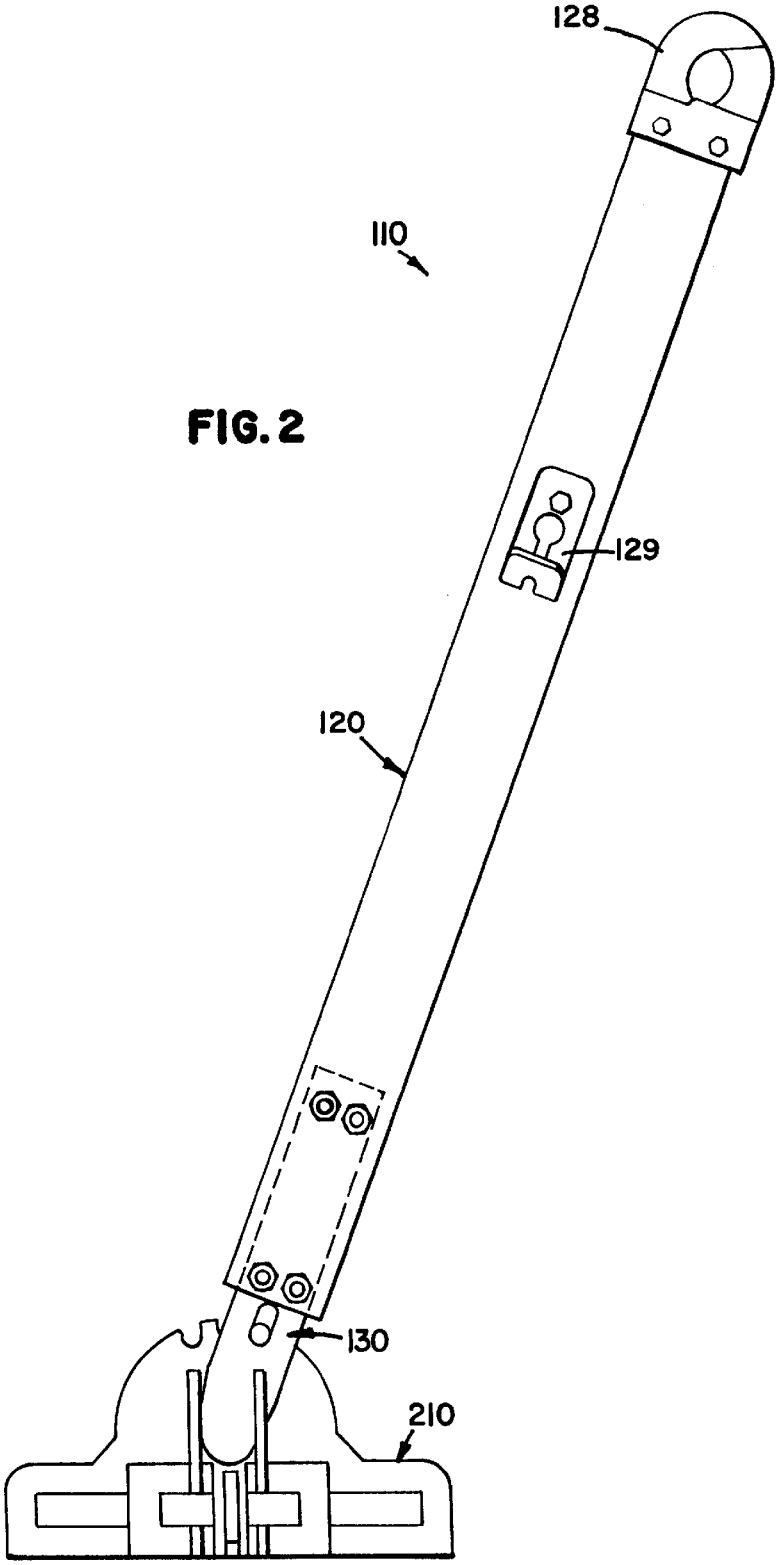
FIG. 2 is an end view of a stanchion assembly that is part of the system shown in FIG. 1.
Figure 3:
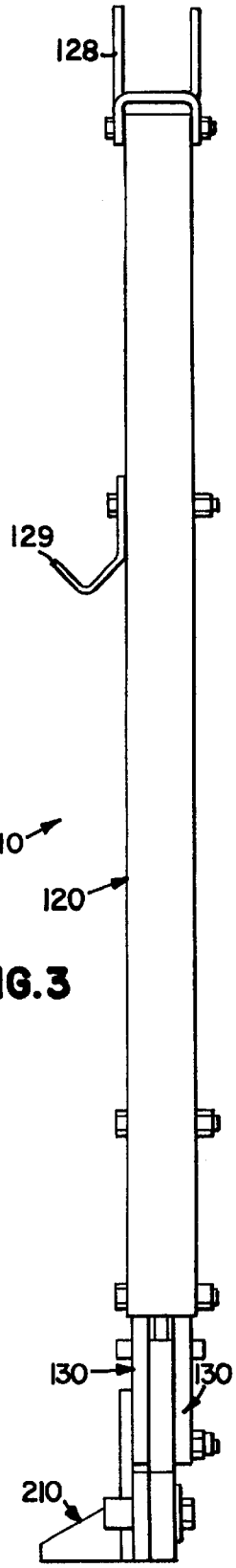
FIG. 3 is a side view of the assembly shown in FIG. 2.

A stanchion assembly 110 is shown by itself in FIGS. 2–3. The assembly 110 may be described in terms of a post 120 which selectively pivots relative to a base 210. A cable supporting bracket 128 is mounted on an upper end of the post 120. The bracket 128 includes overlapping fingers which are axially spaced apart from one another. The fingers are configured to both retain the safety line 180 and facilitate passage of a connector along the safety line 180 from one side of the post 120 to the other. A chain supporting bracket 129 is mounted on an intermediate portion of the post 120. The bracket 129 includes a circular opening having a diameter which exceeds both the width and the thickness of the links in the chain 190, and an adjoining slot having a width which is greater than the thickness of the chain links, but less than their width.

Figure 4:
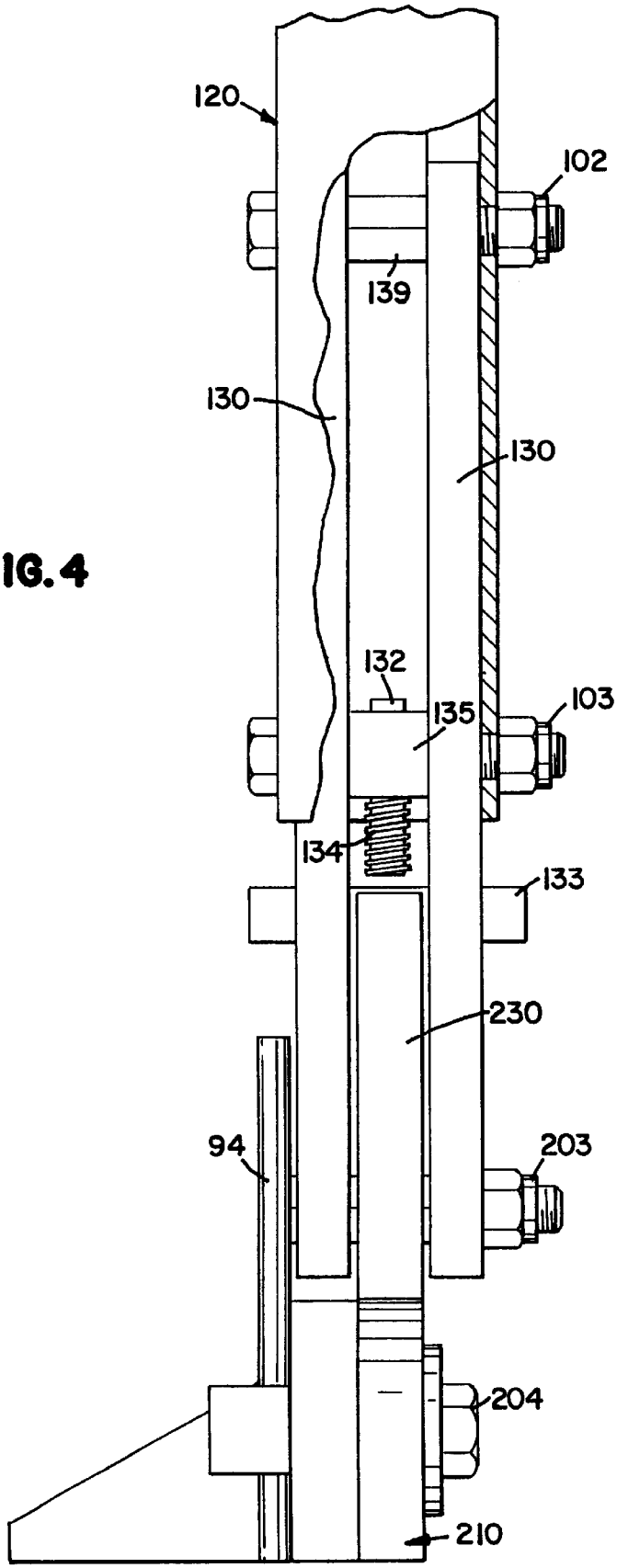
FIG. 4 is an enlarged and partially sectioned side view of the assembly shown in FIG. 3.

FIG. 4 shows the lower end of the post 120 in greater detail. The post 120 may be described as a square tube. Opposing bars 130 are inserted into the lower end of the post 120 and secured in place by respective pairs of transversely extending, mating nuts and bolts 102 and 103. An intervening spacer 139 is sandwiched between the bars 130 proximate their upper ends, and an intervening support 135 is sandwiched between the bars 130 proximate their middle portions. The lower ends of the bars 130 straddle a plate 230 on the base 210 (described below) and are rotatably secured thereto by mating nut and bolt 203. A T-shaped latch includes a longitudinal member or shaft 132 and a transverse member or pin 133. The longitudinal shaft 132 has a first end which extends through a hole in the support 135, and second end which is rigidly secured to the transverse pin 133. A helical coil spring 134 is disposed on the longitudinal shaft 132 and is compressed between the transverse pin 133 and the support 135. The spring 134 biases the transverse pin 133 toward the plate 230. A circular depression may be provided in the support 135 to retain or seat the proximate end of the spring 134.

Figure 6:
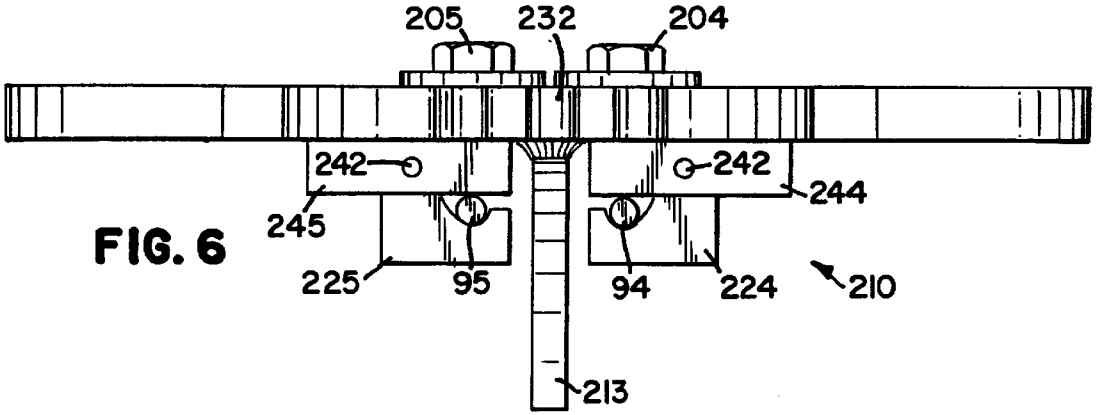
FIG. 6 is a top view of the base portion shown in FIG. 5.
Figure 5:
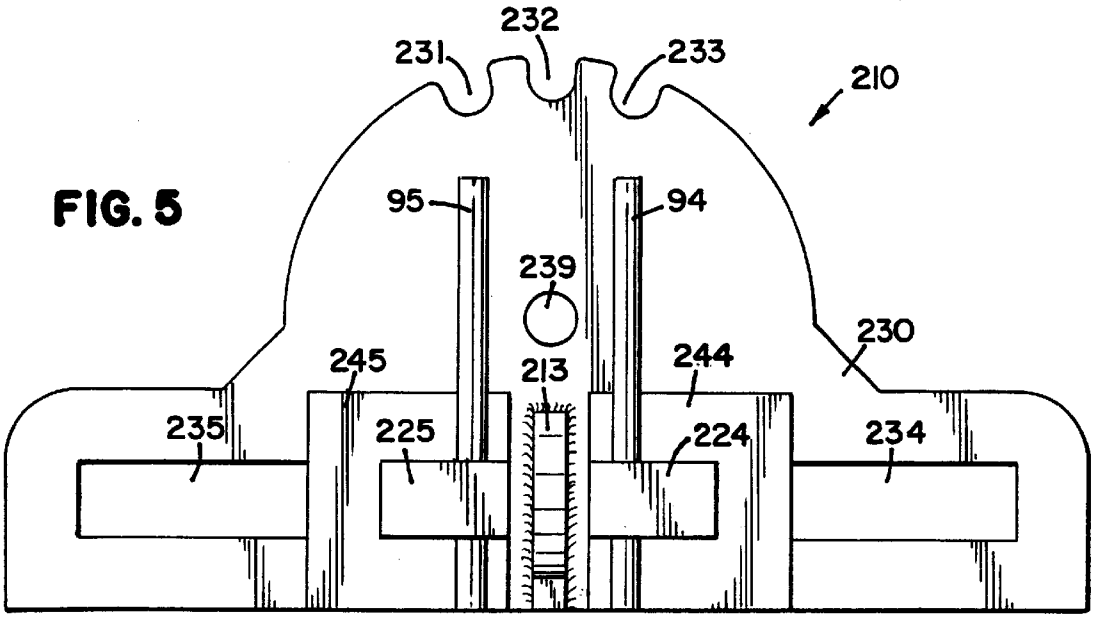
FIG. 5 is an end view of a base portion that is part of the assembly shown in FIG. 2.
Figure 7:
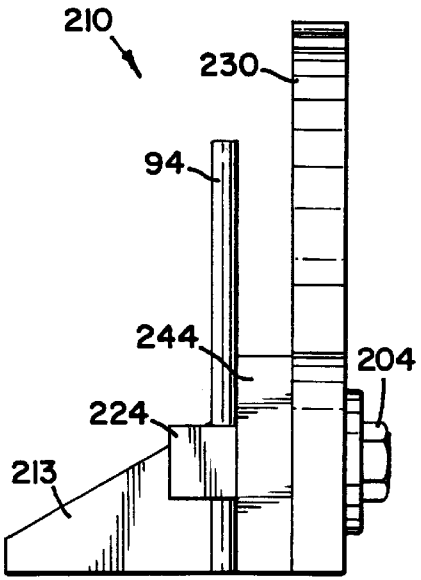
FIG. 7 is a side view of the base portion shown in FIG. 5.

The base 210 is shown by itself in FIGS. 5–7. The base 210 includes the plate 230 and an orthogonally extending flange 213. The base 210 is symmetrical about a plane which bisects the flange 213 and extends perpendicular to the plate 230. The bottoms of the plate 230 and the flange 213 lie flush against the top of the beam 90. A hole 239 extends through a central portion of the plate 230 to receive the bolt 203. Notches 231–233 extend into the upper edge of the plate 230 to retain the transverse pin 133 at respective orientations. When the pin 133 occupies the center notch 232, the post 120 extends vertically upward from the horizontal beam 90. When the pin 133 occupies either of the notches 231 or 233, the post 120 defines an angle of twenty degrees relative to vertical.

Laterally extending slots 234 and 235 extend through the plate 230 proximate its lower edge. The slots 234 and 235 are sized and configured to receive and accommodate lateral repositioning of respective hook members 224 and 225. The hook members 224 and 225 are slidably secured to respective U-shaped blocks 244 and 245 by respective spring pins 242 (shown in FIG. 6). The U-shaped blocks 244 and 245 open toward one another. The hook member 224 (which is a mirror image of the hook member 225) is shown in greater detail in FIGS. 8–9. A threaded bolt hole 221 extends transversely through a first portion of the hook member 224 and toward an opposing second portion of the hook member 224. A notch 223 in the second portion is contoured to receive and hook a portion of a reinforcement bar. A transversely extending groove is provided in the top of the hook member 224 to accommodate the pin 242 and thereby slidably connect the hook member 224 to the U-shaped block 244.

Figure 12:
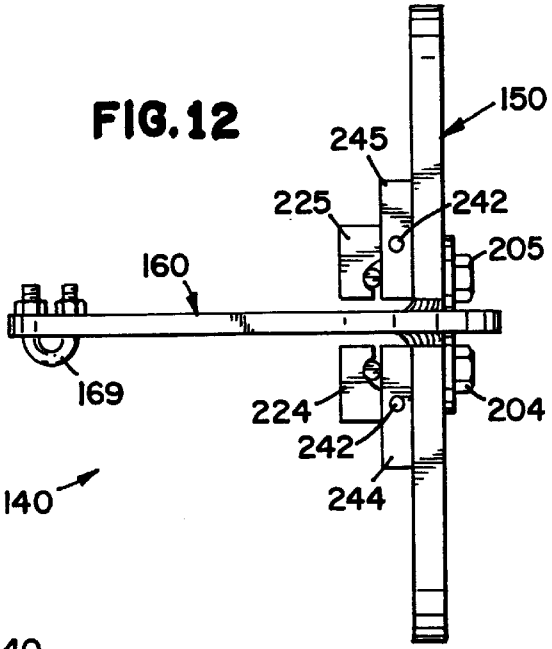
FIG. 12 is a top view of the assembly shown in FIG. 11.
Figure 11:
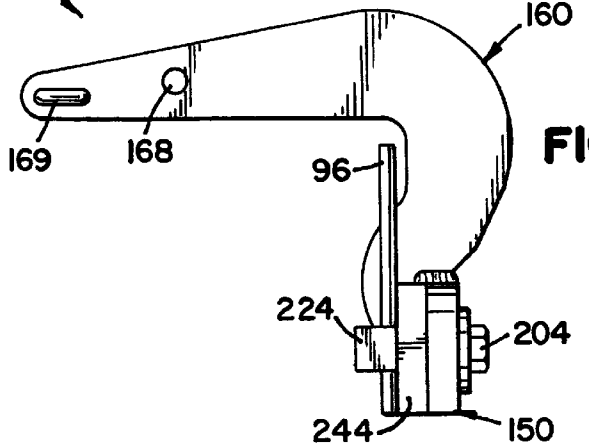
FIG. 11 is a side view of the assembly shown in FIG. 10.
Figure 10:
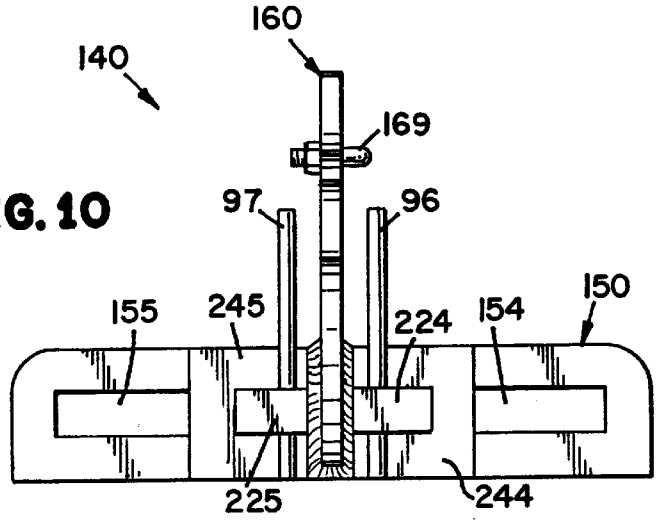
FIG. 10 is an end view of an end anchor assembly that is part of the system shown in FIG. 1.

An end anchor assembly 140 is shown by itself in FIGS. 10–12. The assembly 140 includes a base plate 150 and an orthogonally extending anchorage member 160 which are rigidly secured to one another (by welding or other suitable means). The assembly 140 is symmetrical about a plane which bisects the anchorage member 160 and extends perpendicular to the plate 150. The bottom of the plate 150 lies flush against the top of the beam 90. A U-bolt 169 is secured to a distal end of the anchorage member 160 for purposes of anchoring an end of the safety line 190 relative thereto. Also, a hole 168 extends through an adjacent portion of the anchorage member 160 for purposes of anchoring an end of the chain 180 relative thereto.

Laterally extending slots 154 and 155 (similar in size and shape to the slots 234 and 235) extend through the plate 150. The slots 154 and 155 are sized and configured to receive and accommodate lateral repositioning of respective hook members 224 and 225 (identical to those on the stanchion assembly 120). The hook members 224 and 225 are secured to respective U-shaped blocks 244 and 245 by spring pins 242 (also identical to those on the stanchion assembly 120). The commonality of parts is not critical to the operation of the present invention, but is considered advantageous to the extent that it contributes to manufacturing efficiency.

The preferred embodiment system 100 is installed after determining the desired span of the safety line 180. The end anchor assemblies 140 are positioned at the opposite ends of the safety line 180 with the anchorage members 160 extending toward one another. The assemblies 140 are then secured in place relative to the most suitable reinforcement bars (designated as 96 and 97 in FIG. 10). More specifically, the opposing hook members 224 and 225 are positioned on opposite, outer sides of the reinforcing bars 96 and 97 and then maneuvered until the bars 96 and 97 are inside the notches 223 on respective hook members 224 and 225. The bolts 204 and 204 are then tightened so that the bars 96 and 97 are clamped between respective hook members 224 and 225 and respective U-shaped blocks 244 and 245. As a result, each bar is clamped between bearing surfaces which are diametrically opposed and axially offset relative to one another (relative to the longitudinal axis of the bar).

A respective stanchion assembly 110 is positioned inside each of the end anchor assemblies 140 with the chain bracket 129 and the flange 213 extending toward the adjacent end anchor assembly 140. The arrangement is preferably such that the safety line 180 will extend at an angle between thirty and forty degrees relative to the beam 90. In a manner similar to the end anchor assemblies 140, the stanchion assemblies 110 are secured in place relative to the most suitable reinforcement bars (designated as 94 and 95 in FIG. 5). The flange 213 is positioned to extend between the two bars 94 and 95. A first end of the chain 190 is secured to the U-bolt 169, and an opposite end of the chain 190 is inserted through the chain bracket 169. The chain 190 is pulled taut, and as many links as possible are pulled through the hole in the bracket 169 before a particular link is maneuvered into the slot in the bracket 169.

At each end of the system 100, a tensioning device or turnbuckle 188 is connected in series between the anchorage member 160 and an energy absorbing device 184. A sleeve member 182 is connected to an opposite end of the energy absorber 184, and an end portion of the safety 180 is routed about the sleeve member 182. Intermediate portions of the safety line 180 are maneuvered through respective brackets 168 on the posts 120. Then, with the line 180 pulled taut, portions of the line on opposite sides of the sleeve member 182 are secured together (by cable clips 186 or other suitable means). Tension in the line 180 may be increased (or decreased) by adjusting the turnbuckle 188. The position of the line 180 relative to the beam 90 may be adjusted by pulling upward on each pin 133 and pivoting each post 120 to an alternative position. To minimize resistance to pivoting, the common pivot axis of the posts 120 should align with the line and chain connection points on the end anchor assemblies 140, and the connection points should be fitted with swivels.

Figure 13:
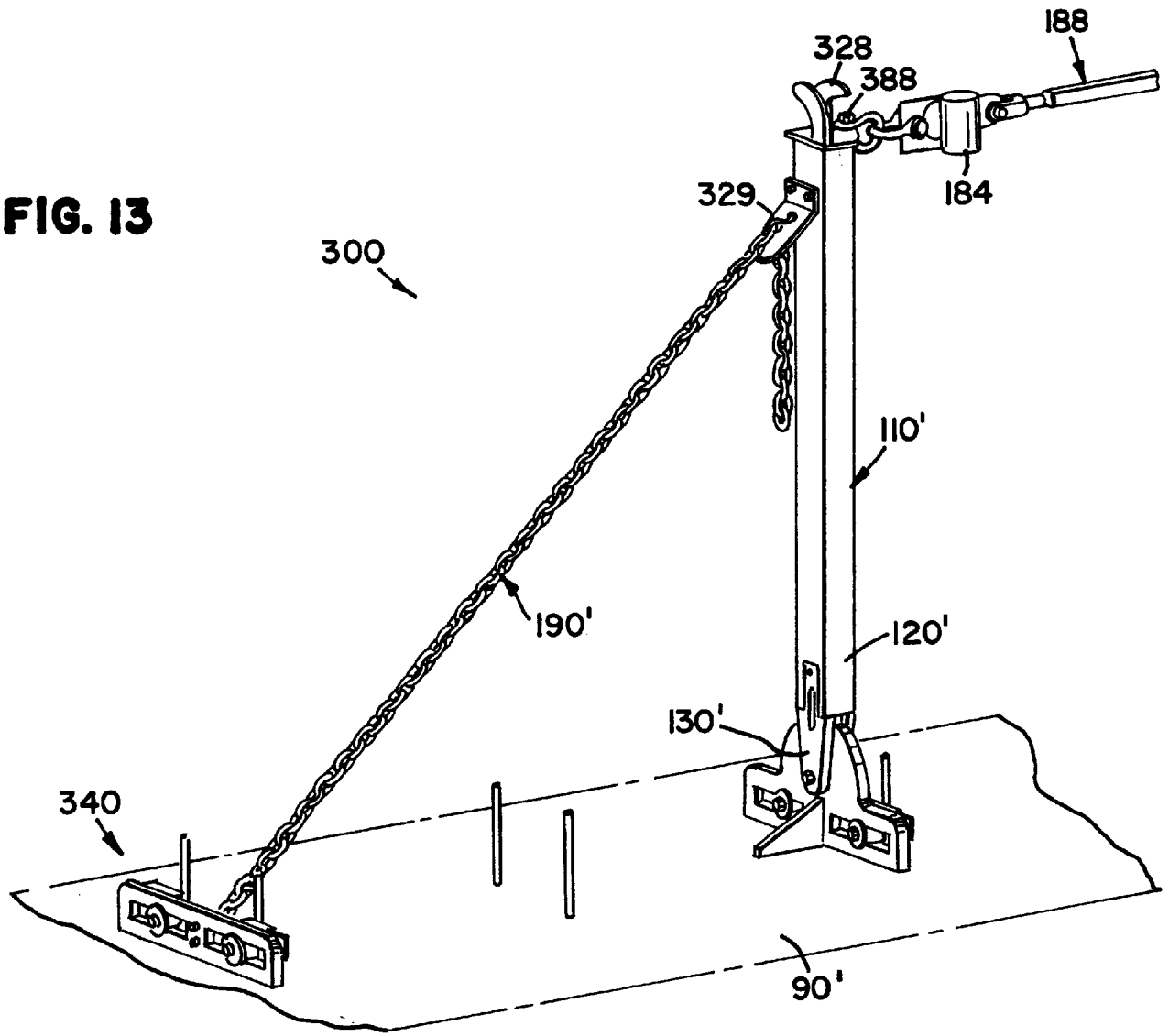
FIG. 13 is a perspective view of one end of another horizontal safety line system constructed according to the principles of the present invention.

FIG. 13 shows a second safety system 300 constructed and installed according to the principles of the present invention. As suggested by the common reference numerals, the system 300 is similar in many respects to the first system 100. Accordingly, the description of the second system 300 will focus primarily on the distinctions.

The system 300 includes a stanchion assembly 110', an end anchor assembly 340, a safety line (not shown), and a connector 190'. The system 300 is installed and operated in much the same manner as the system 100, except that an energy absorber 184 is interconnected between the stanchion assembly 110' and a first end of a line tensioner 188, and an opposite, second end of the line tensioner 188 is secured to the safety line.

There are three noteworthy distinctions between the stanchion assembly 110' and the stanchion assembly 110. First, the post 120' is welded, rather than bolted, to the bars 130'. Second, the cable supporting bracket 128 has been replaced by a cable supporting bracket 328 having an additional flange that is configured to receive and support a line anchoring bolt 388. Third, the bracket 129 has been replaced by a similarly configured bracket 329 that is secured to a different part of the post 120' by means of two mating nuts and bolts.

Figure 14:
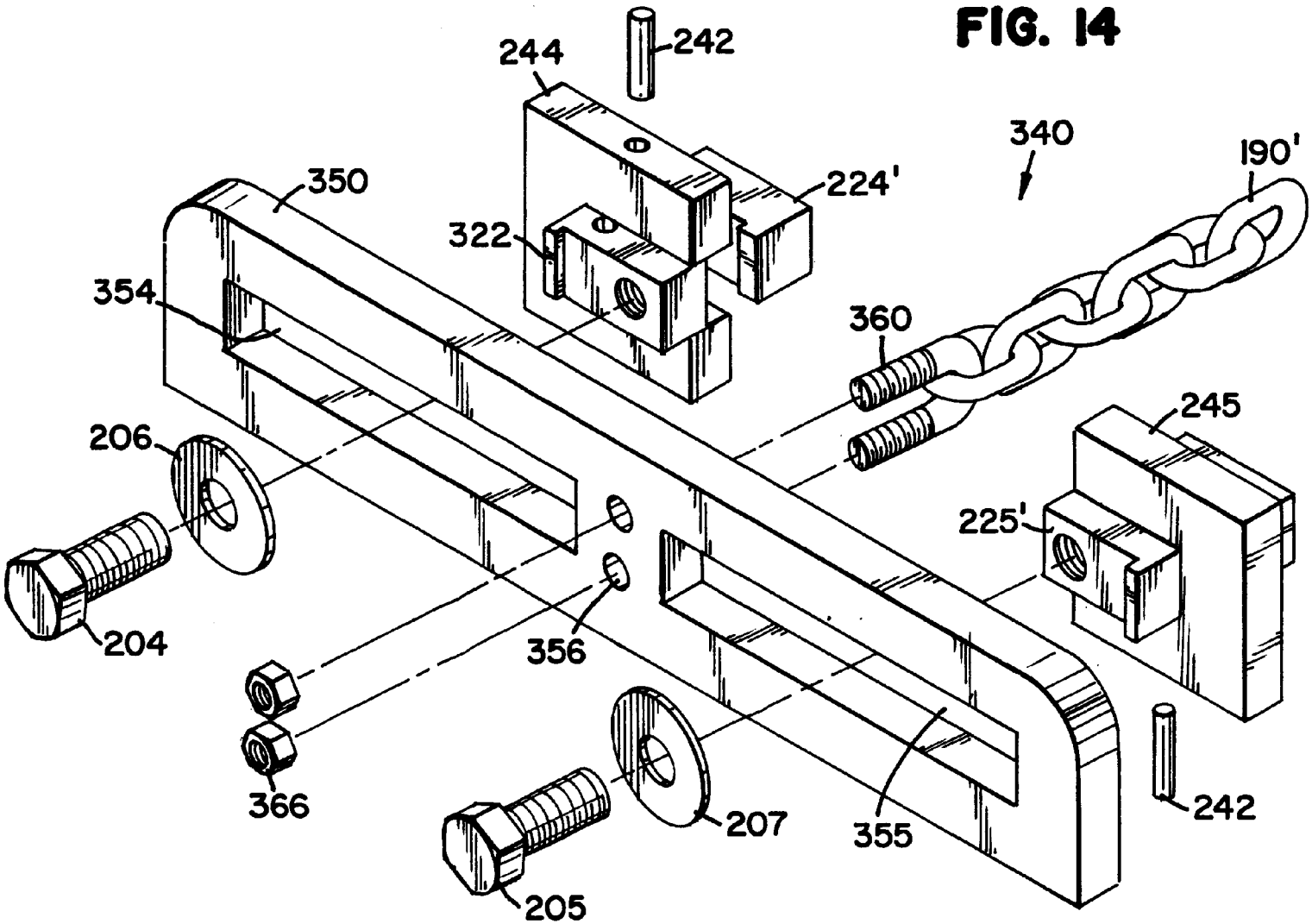
FIG. 14 is an exploded perspective view of an end anchor assembly that is part of the system shown in FIG. 13.

The end anchor assembly 340 is shown in greater detail in FIG. 14. There are three noteworthy distinctions between the end anchor assembly 340 and the end anchor assembly 140. First, only the chain 190' extends between the stanchion 110' and the end anchor assembly 340. Second, the hook-shaped anchorage member 160 has been replaced by a U-bolt 360. The distal ends of the U-bolt 360 insert through respective holes 356 in the plate 350 and mate with respective nuts 366. Third, the hook members 224 and 225 have been replaced by hook members 224' and 225' that have a protruding flange or shoulder 322 to provide additional bearing surface.

Like the plate 150, the plate 350 has slots 354 and 355 sized and configured to receive and accommodate lateral repositioning of respective hook members 224' and 225'. The hook members 224' and 225' are secured to respective U-shaped blocks 244 and 245 by spring pins 242. For reasons of manufacturing efficiency, the hook members 224' and 225' are made identical to one another, and the blocks 244 and 245 are made identical to one another, and the left side parts are then rotated one hundred and eighty degrees relative to the right side parts. As a result, the pins 242 insert into opposite facing sides of respective blocks 244 and 245. Bolts 204 and 205 are inserted through respective washers 206 and 207 and respective slots 354 and 355, and then threaded into respective hook members 224' and 225'.

Although the present invention has been described with reference to specific embodiments and a particular application, this disclosure will enable those skilled in the art to recognize additional embodiments, improvements, and/or application that incorporate the essence of the present invention. Accordingly, the scope of the present invention should be limited only to the extent of any allowed claims.

What is claimed is:

1. A method of supporting a safety line relative to a concrete beam of the type having a top surface and reinforcing bars protruding upward beyond the top surface, comprising the steps of:

providing a concrete beam of the type having a top surface and at least four reinforcing bars protruding upward beyond the top surface;

(a) providing a safety line having a first end and a second end and a length defined therebetween;

(b) providing first and second end anchor assemblies, each including a base and at least one clamp movably mounted on the base;

(c) positioning the anchor assemblies at discrete positions along the beam, spaced less than the length apart from one another;

(d) using the at least one clamp on the first of the anchor assemblies to clamp the first of the anchor assemblies to at least two respective said reinforcing bars, and using the at least one clamp on the second of the anchor assemblies to clamp the second of the anchor assemblies to at least two respective said reinforcing bars;

(e) providing at least two stanchion assemblies, each including a base, at least one clamp movably mounted on the base, and a post connected to the base;

(f) positioning the stanchion assemblies at discrete positions along the beam, apart from and between the first and second anchor assemblies;

(g) using the at least one clamp on the first of the stanchion assemblies to clamp the first of the stanchion assemblies to at least two respective said reinforcing bars, and using the at least one clamp on the second of the stanchion assemblies to clamp the second of the stanchion assemblies to at least two respective said reinforcing bars;

(h) providing at least two flexible members, and securing each of the flexible members between a respective one of the anchor assemblies and a respective said post on a most proximate one of the stanchion assemblies and (i) securing the safety line in tension between each said post.

2. The method of claim 1, wherein for each of the anchor assemblies, the at least one clamp includes two hook members, and step (d) involves arranging the hook members about the respective said reinforcing bars, and drawing the hook members toward the base to clamp the bars therebetween.

3. The method of claim 2, wherein for each of the anchor assemblies, the at least one clamp includes two bolts, and step (d) involves inserting distal ends of respective bolts through the base and threading the distal ends into respective said hook members.

4. The method of claim 1, wherein for each of the stanchion assemblies, the at least one clamp includes two hook members, and step (g) involves arranging the hook members about the respective said reinforcing bars, and drawing the hook members toward the base to clamp the respective said reinforcing bars therebetween.

5. The method of claim 4, wherein for each of the stanchion assemblies, the at least one clamp includes two bolts, and step (g) involves inserting distal ends of respective said bolts through the base and threading the distal ends into respective said hook members.

6. The method of claim 1, wherein step (i) involves securing an energy absorbing device between at least one end of the safety line and a respective one of the posts.

7. The method of claim 1, wherein step (i) involves securing a tensioning device between at least one end of the safety line and a respective one of the posts.

8. The method of claim 1, wherein for each of the anchor assemblies, step (h) involves securing a respective end of a chain to a respective one of the anchor assemblies, and securing a link in the chain to the post in such a manner that the chain is taut between the link and the respective end.

9. The method of claim 1, further comprising (i) for each of the stanchion assemblies, selectively pivoting the post relative to the base to selectively pivot the safety line about a pivot axis which extends parallel to a longitudinal axis of the beam.

10. The method of claim 9, wherein step (j) is performed after steps (a)–(i).

11. The method of claim 1, wherein each said clamp is provided with opposing bearing surfaces that engage opposite sides of a respective one of the reinforcing bars, and that occupy discrete, axially offset positions along a longitudinal axis defined by the respective one of the reinforcing bars.

12. The method of claim 1, wherein each said clamp is provided with opposing bearing surfaces, and both of said bearing surfaces are movable relative to a respective said base.

13. The method of claim 1, wherein each said securing step is performed in a manner that secures both the safety line and the flexible members to points within a common plane.

14. A method of securing a personal safety device to a concrete beam of the type having a top surface and reinforcing bars protruding upward beyond the top surface, comprising the steps of:

providing a concrete beam of the type having a top surface and reinforcing bars protruding upward beyond the top surface;

(a) providing an anchor assembly having a base, at least two hook members movably mounted on the base, and at least two bolts;

(b) arranging the hook members about respective said reinforcing bars; and (c) threading the bolts into the hook members to move the hook members toward the base and clamp the respective said reinforcing bars therebetween.

15. The method of claim 14, wherein distal ends of respective said bolts are inserted through, the base, perpendicular to the bars, and then threaded into respective said hook members.

16. The method of claim 14, wherein step (c) causes each of the respective said reinforcing bars to bear against a respective one of the hook members at a respective location disposed between first and second parallel planes extending perpendicular to the respective said reinforcing bars, and causes each of the respective said reinforcing bars to bear against opposing bearing surfaces at respective locations disposed on opposite sides of a space defined between the planes.

17. The method of claim 14, wherein the respective said reinforcing bars have longitudinal axes which extend in a first direction, and step (c) causes the hook members to move in a second direction which is perpendicular to the first direction, and step (b) involves moving the hook members relative to the base in a third direction which is perpendicular to both the first direction and the second direction.

18. The method of claim 14, wherein the base is provided with a plate and an orthogonally extending flange which cooperate to define a T-shape, and prior to step (b), the base is positioned relative to the beam in such a manner that the plate rests on the beam and extends parallel to a plane defined by the two respective said reinforcing bars, and the flange rests on the beam and extends between the two respective said reinforcing bars.

19. A method of adjusting a safety line relative to a support structure, comprising the steps of:

providing a safety line;

providing a support structure that is a concrete beam of the type having a top surface and reinforcing bars protruding upward beyond the top surface;

providing at least two stanchion assemblies, each including a base, a post pivotally connected to the base, and a latch selectively secured between the post and the base;

anchoring the base of each of the stanchion assemblies to the support structure in such a manner that pivot axes defined between each said post and each said base align with one another;

securing the safety line to each said post;

diverting an end portion of the safety line downward from the post most proximate the end portion;

anchoring the end portion to the support structure; and after moving the latch to a position free of at least one of the post and the base, moving the post to another orientation relative to the base, and then moving the latch to an alternative position secured between the post and the base.

20. The method of claim 19, wherein the anchoring of the end portion involves anchoring the end portion at a location that is axially aligned with the pivot axes.

21. The method of claim 19, wherein each of the stanchion assemblies is provided with notches that are circumferentially spaced relative to the pivot axes, and sized and configured to accommodate a respective said latch.

22. A safety device anchorage, comprising:

a plate having a length and a height, wherein at least one slot extends through the plate in a direction perpendicular to both the length and the height;

two hook members having respective hook ends and respective base ends, wherein the two hook members extend through the at least one slot and are movable both along the at least one slot in a direction parallel to the length and in telescoping fashion relative to the at least one slot in a direction perpendicular to the length, and the two hook members are arranged so that the hook ends project outward from the plate, open in opposite directions, and cooperate with the plate to define respective gaps therebetween; and two bolts extending through the plate and threaded into the base ends of respective said hook members in such a manner that rotation of the bolts makes the respective gaps change size.

23. The safety device anchorage of claim 22, further comprising a flange rigidly secured to the plate and extending in the direction perpendicular to both the length and the height, wherein the two hook members are disposed on opposite sides of the flange.

24. The safety device anchorage of claim 22, wherein each of the hook members includes a first bearing surface which opposes a second bearing surface and a third bearing surface, and the first bearing surface is disposed between a first plane and a second plane which extend perpendicular to the height, and the second bearing surface is disposed on an opposite side of the first plane, and the third bearing surface is disposed on an opposite side of the second plane.

25. The safety device anchorage of claim 22, wherein the at least one slot includes a first slot, and a first one of the hook members extends through the first slot, and a first one of the bolts extends through the first slot.

26. The safety device anchorage of claim 25, wherein the at least one slot includes a second slot, and a second one of the hook members extends through the second slot, and a second one of the bolts extends through the second slot.

27. The safety device anchorage of claim 23, wherein the bolts have heads that bear against respective, co-planar bearing surfaces on the plate.

28. The safety device anchorage of claim 23, further comprising two blocks configured and arranged to bear against the plate, wherein each of the hook members extends through a respective one of the blocks.

29. The safety device anchorage of claim 22, wherein the plate is bounded by first and second planes that extend parallel to both the height and the length.

* * * * *